United States Patent [19]

Link

[11] 4,080,582

[45] Mar. 21, 1978

[54] CIRCUIT BREAKER WITH IMPROVED TRIP MECHANISM

[75] Inventor: Donald A. Link, Hubertus, Wis.

[73] Assignee: Cutler-Hammer, Inc., Milwaukee, Wis.

[21] Appl. No.: 723,317

[22] Filed: Sep. 15, 1976

[51] Int. Cl.[2] ..... H01H 75/12

[52] U.S. Cl. ..... 335/37; 335/45

[58] Field of Search ..... 335/23, 35, 37, 45; 337/59, 66; 200/51.09

[56] References Cited

U.S. PATENT DOCUMENTS

| | | | |
|---|---|---|---|
| 2,654,008 | 9/1953 | Toth et al. | 335/37 |
| 2,952,757 | 9/1960 | Ellenberger | 337/66 |
| 2,989,605 | 6/1961 | Leonard | 335/35 |
| 2,989,606 | 6/1961 | Walker et al. | 335/37 |
| 3,046,371 | 7/1962 | Jencks | 335/35 X |
| 3,072,763 | 1/1963 | Goodwin, Jr. | 335/76 |
| 3,188,416 | 6/1965 | Schultz | 200/51.09 |
| 3,480,890 | 11/1969 | Layton et al. | 335/23 |
| 3,585,541 | 6/1971 | Erickson | 335/45 |
| 3,849,751 | 11/1974 | Link et al. | 337/59 |

*Primary Examiner*—George Harris

*Attorney, Agent, or Firm*—Hugh R. Rather; William A. Autio; Michael E. Taken

[57] ABSTRACT

A single-pole circuit breaker or a plural-pole circuit breaker of the type having a common trip bar extending between poles whereby any pole tripping acts therethrough to trip the other pole or poles. The breaker is provided with an improved trip mechanism comprising a subassembly for each pole wherein all of the thermal and magnetic trip elements are mounted on a breaker terminal plate that acts as a base therefor and which is secured to the breaker housing. This trip mechanism also comprises shunt contacts mounted on the armature and bimetal for closing a protective shunt across the bimetal on magnetic trip and for rocking action on shunt contacts due to bimetal movement to break any welds therebetween; a field test mechanism having a spring-biased rotary trip member accessible from the outside and an eccentric lever attached thereto for manually tripping the breaker for test purposes; and an insulator lining the lower surface of the contact finger to prevent the arc from re-striking below the contact when the contacts trip open thereby to enhance completion of the tripping action.

15 Claims, 8 Drawing Figures

Fig. 1
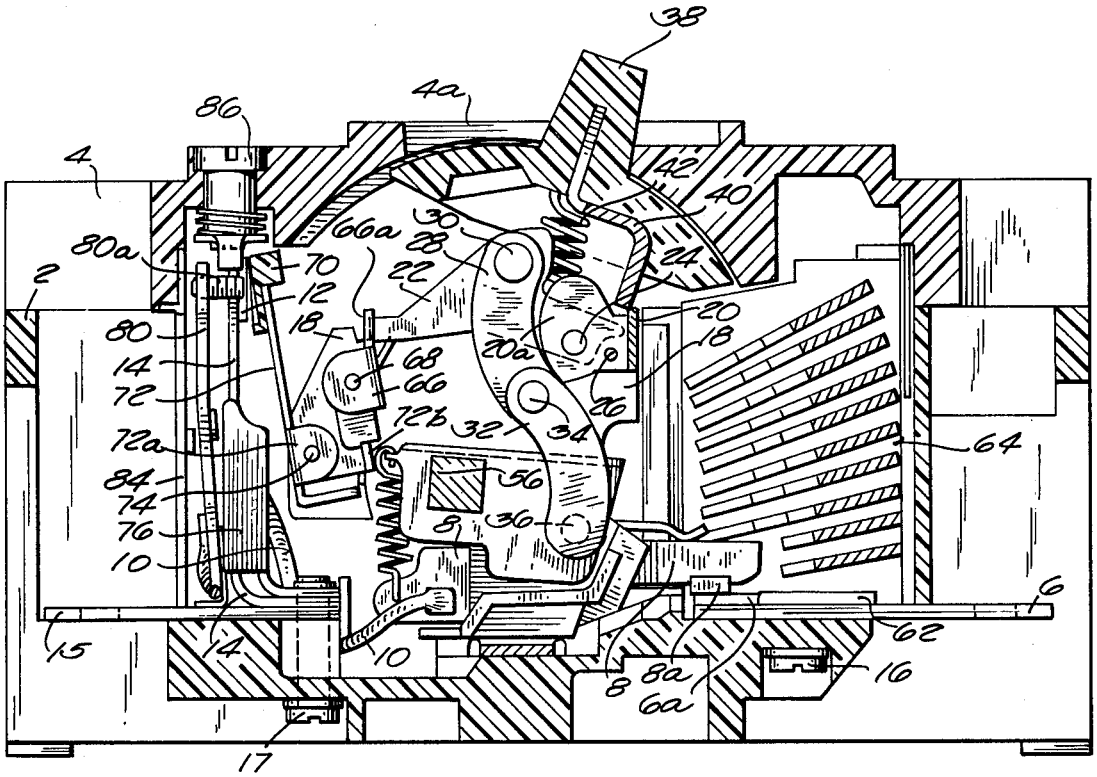
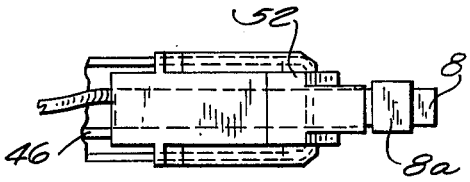
Fig. 7
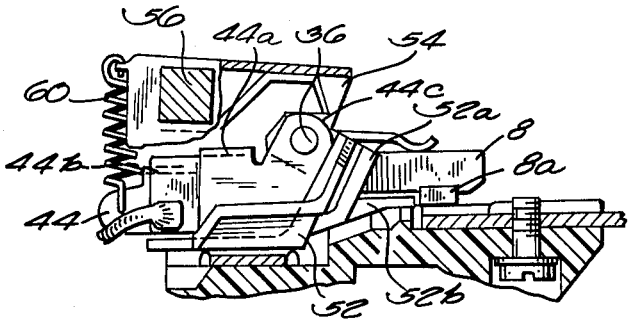
Fig. 6

Fig. 2
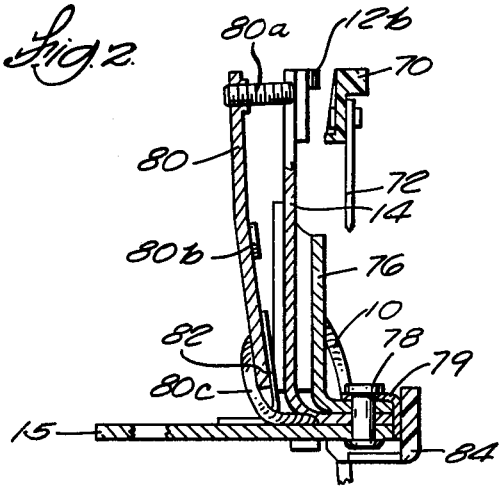
Fig. 3
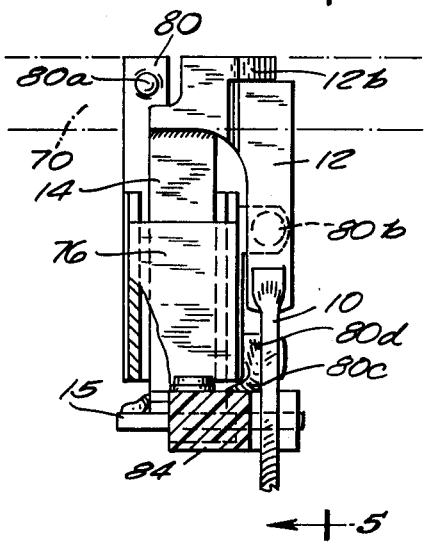
Fig. 5
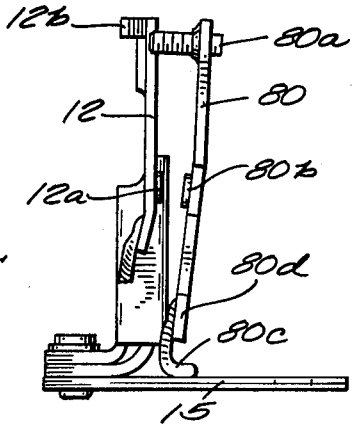
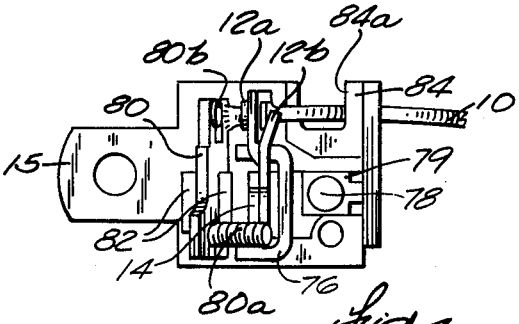
Fig. 4
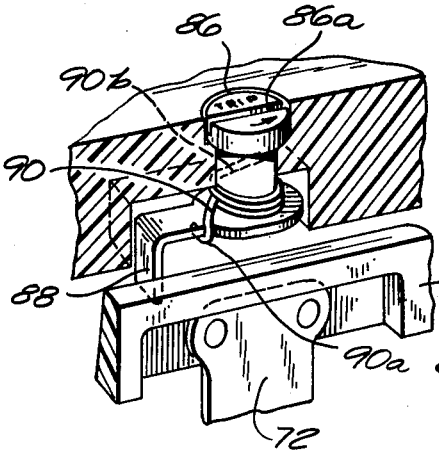
Fig. 8

CIRCUIT BREAKER WITH IMPROVED TRIP MECHANISM

BACKGROUND OF THE INVENTION

Single-pole and plural-pole circuit breakers have been known heretofore. For example, D. A. Link et al U.S. Pat. No. 3,849,751, dated Nov. 19, 1974, discloses circuit breakers of that type. While these prior circuit breakers have been useful for their intended purposes, this invention relates to improvements thereover.

SUMMARY OF THE INVENTION

An object of the invention is to provide an improved circuit breaker.

A more specific object of the invention is to provide improved circuit breakers of the single-pole or plural-pole type.

Another specific object of the invention is to provide a circuit breaker with improved trip means.

Another specific object of the invention is to provide a circuit breaker with an improved thermal and magnetic trip subassembly.

Another specific object of the invention is to provide such improved thermal and magnetic trip subassembly with an improved bimetal shunting switch that not only protects the bimetal but also affords rocking action between the shunting switch contacts to break any welds that might occur.

Another specific object of the invention is to provide an improved plural-pole circuit breaker incorporating a common trip bar and a spring-biased rotary trip member accessible from the outside for manually test-tripping the breaker poles.

Another specific object of the invention is to improve the tripping of a circuit breaker by providing its movable contact finger with an insulating liner to prevent the arc from re-striking below the contact on opening.

Another specific object of the invention is to provide a circuit breaker with an improved trip mechanism that is simple and economical in construction and easy to assemble.

Other objects and advantages of the invention will hereinafter appear.

BRIEF DESCRIPTION OF THE DRAWINGS

FIG. 1 is a longitudinal cross-sectional view of a single-pole circuit breaker or one pole of a plural-pole circuit breaker showing a front elevational view of the internal mechanism thereof according to the invention;

FIG. 2 is a front elevational view, partly in section, of the thermal and magnetic trip mechanism subassembly of the circuit breaker of FIG. 1;

FIG. 3 is a right side view, partly in section, of the trip mechanism subassembly of FIG. 2;

FIG. 4 is a top view of the trip mechanism subassembly of FIGS. 2 and 3;

FIG. 5 is a rear view of the trip mechanism subassembly of FIG. 2;

FIG. 6 is a front elevational view of the movable contact finger and associated parts of the circuit breaker of FIG. 1 showing the insulating liner;

FIG. 7 is a bottom view of the movable contact finger of FIG. 6 showing the insulating liner mounted thereon; and FIG. 8 is an isometric view of a field test mechanism.

DESCRIPTION OF THE PREFERRED EMBODIMENT

Referring to FIG. 1, there is shown one pole of a plural-pole circuit breaker constructed in accordance with the invention. A single-pole circuit breaker is similar except that a shorter single-pole trip bar is used in place of the common trip bar. As shown therein, this circuit breaker is provided with a housing comprising a case 2 and a cover 4 closing the top of the case and secured thereto by a pair of rivets, screws, or the like, not shown. Devices of this type are known as molded case circuit breakers since the case and cover are molded of plastic electrically insulating material. In a two-pole breaker, the housing provides two compartments separated by a dividing wall. In a three-pole breaker, the housing provides three compartments separated by two dividing walls. In a single-pole breaker, the housing provides one compartment. As shown in FIG. 1, these compartments are mostly within the base and extend partly up into the cover. The trip mechanisms of the different poles are generally similar except that one of the trip mechanisms additionally has a manually-operable rotary trip member shown in FIGS. 1 and 8 accessible from the outside for field testing the circuit breaker. Suitable apertures are provided in the dividing walls between the compartments through which certain common members extend, such as the common trip bar and the common shaft on which the movable contact finger assemblies of the several poles are mounted.

Each pole of the circuit breaker includes a protective current path therethrough, the term protective meaning that this current path will open under thermal action in response to sustained small overload current or under magnetic action in response to a sudden large overload current. As shown in FIG. 1, this current path extends from the right (line side) to the left (load side), that is, from terminal plate 6 through stationary contact **6*a* mounted thereon, movable contact 8*a* and contact finger 8 on which it is mounted, flexible stranded conductor 10 known as a "pigtail", shunt contact carrier portion or bracket 12 attached to the bimetal at its upper end as shown in FIG. 3, and bimetal 14 to terminal plate 15. In actual practice, suitable wire lugs are attached to terminal plates 6 and 15 to facilitate connection of line and load conductors thereto. This is done by inserting screws through the holes in the terminal plates from below into threaded engagement with the wire lugs resting on top of the terminal plates or by other securing means. These terminals plates 6 and 15 are secured to case 2 by screws 16 and 17**, respectively, so that their connector portions extend from the breaker compartments through suitable holes to the outside.

One pole of the circuit breaker also includes a pair of complementary, spaced, upstanding brackets 18 and 20 shown in FIG. 1 for supporting a toggling and latching mechanism hereinafter described. These brackets have inwardly offset closely spaced tabs (such as **20*a*) that support therebetween a latch lever 22 on pivot pin 24. A pin 26 mounted on and extending through these tabs serves as a stop to limit clockwise pivotal movement of the latch lever when the breaker is tripped. A pair of upper, curved parallel toggle links 28 are pivotally supported at their upper ends on opposite sides of latch lever 22 by pivot pin 30. A pair of lower, oppositely-curved, spaced parallel toggle links 32 are pivotally supported at their upper ends on opposite sides of the lower ends of toggle links 28 by knee pin 34. The lower ends of toggle links 32 are pivotally connected to the opposite sides of the movable contact assembly by pivot pin 36**.

This toggling and latching mechanism also comprises an insulating operating handle 38 having a metal operating lever 40 secured thereto. This operating lever 40 has a pair of spaced legs provided with semi-circular notches at their lower ends whereby this operating lever is pivotally supported on a pair of trunnions integral with the outside surfaces of the aforesaid brackets 18 and 20, these legs straddling the toggle mechanism. A pair of helical tension springs 42 extend between operating lever 40 and knee pin 34. These tension springs are known as overcenter toggle springs and their upper end hooks are seated in spaced notches on operating lever 40. These springs extend downwardly in parallel relation and their lower end hooks are seated in spaced grooves near the ends of knee pin 34 inwardly of links 32.

The aforementioned movable contact assembly comprises movable contact finger 8 and contact 8*a* of good electrically conducting metal such as silver or the like secured thereto. This movable contact finger 8 is supported by a U-shaped bracket 44 encircling the contact finger and secured thereto by bending tabs 44*a* thereover and staking this bracket to the contact finger. Tab 44*b* on this bracket is bent rearwardly to abut the lower edge of frame 54 to limit clockwise rotation of the contact finger about pivot pin 36 extending through upstanding tabs (such as 44*c*) next to be described, pivotally securing the contact finger assembly to frame 54.

The movable contact finger assembly is pivotally supported by bracket 44. For this purpose, this bracket is provided with aligned holes through its upstanding tabs such as 44*c* shown in FIG. 6. An insulating liner 52 hugs the lower surface of movable contact finger 8 and is provided with a pair of integral, spaced upstanding tabs 52*a* having holes therein. These tabs extend up the sides of the contact finger and inside bracket supporting tabs (such as tab 44*c* shown in FIG. 6). The aforementioned pivot pin 36 extends through these holes in these tabs 44*c* of bracket 44 and tabs 52*a* of liner 52 as well as through holes in a straddling frame 54 of a shaft assembly to pivotally support the movable contact finger assembly on the shaft assembly.

In addition to frame 54, this shaft assembly comprises a shaft 56 having square portions extending through square holes in the two side skirts of the inverted U-shaped frame 54 and welding or clamping is provided to rigidly secure the frame to the shaft. A leaf spring 58 is rigidly secured to the frame and its free end portion presses down on contact finger 8 to provide suitable contact pressure. A helical tension spring 60 is hooked between the left end of bracket 44 and frame 54 for resilient coupling of the shaft assembly to the movable contact finger assembly and to assist in providing suitable contact pressure when the contacts are closed.

As shown in FIGS. 6 and 7, liner 52 consists of a molded insulating member covering the lower surface of movable contact finger 8 throughout most of its length and has a rightwardly extending tongue 52*b* extending almost up to contact 8*a*. The upper surface of this insulating liner has a groove in which the movable contact finger rests. The two upstanding tabs 42*a* extend up at a forward angle and then abruptly change to a rearward angle as shown in FIG. 6, whereat pivot pin 36 extends through them and through tabs 44*c* as a support for the movable contact finger. This insulating liner prevents the arc from re-striking on the lower surface of the contact finger to the left of contact 8*a* when the contacts open during overload current conditions. Thus, this insulator assists in the current interruption.

An arc interrupting structure including an arc plate 62 attached to the upper surface of terminal plate 6 immediately adjacent stationary contact 6*a* and a series of spaced arc plates 64 are provided to effect arc interruption when the contacts are opened.

A spring-returned latch 66 is pivotally mounted between brackets 18 and 20. For this purpose, a pivot pin 68 extends through these brackets and through spaced, perforated tabs on the latch. This latch has a catch 66*a* whereby it engages the left end of latch lever 22 to keep the breaker contacts closed. When this latch is released to allow it to rotate a small amount counterclockwise, it releases the latch lever to trip the breaker contacts open.

A common trip lever assembly is provided for tripping the aforementioned latch. This common trip lever assembly includes a common trip bar 70 and a spring-returned trip lever 72. The common trip bar extends to the adjacent pole or poles so that when one pole trips open, it will also trip open the adjacent pole or poles. The trip lever has a pair of spaced, perforated tabs 72*a* whereby it is pivotally supported between brackets 18 and 20 by a pivot pin 74. This trip lever is provided with a lateral tab 72*b* that engages a notch at the lower portion of latch 66 to hold the breaker contacts closed. When this common trip lever assembly is pivoted slightly clockwise, tab 72*b* disengages the notch to release latch 66, allowing latch lever 22 to slip off catch 66*a* thereby tripping the breaker. The single-pole breaker uses a short insulating member in place of common trip bar 70.

The thermal and magnetic trip subassembly is shown at the left-hand portion of FIG. 1 and FIGS. 2–5, there being one for each pole of the breaker. As shown therein, a bimetal strip 14 and a ferrous metal magnet 76 are mounted by a rivet 78 near the right end and on top of terminal plate 15. Both the bimetal strip and the magnet are generally L-shaped having a hole through the foot of the L through which the rivet extends. The foot of the magnet is stacked on top of the foot of the bimetal strip and are held by a retainer 79 and they are then riveted to the terminal plate. Retainer 79 is a plate having a hole through which the rivet passes and a downwardly bent finger snugly fitting into notches in the ends of the magnet, bimetal and terminal plate to hold them aligned so that the bimetal strip extends up through the elongated U-shaped vertical portion of the magnet as shown in FIG. 2 thereby serving as a one-turn coil to magnetize the magnet whenever current flows in the bimetal strip.

This trip subassembly is also provided with an armature 80 in the form of a ferrous metal plate. This armature is mounted on terminal plate 15 by an inverse L-shaped resilient leaf spring 82. The foot of this leaf spring is riveted to the upper surface of the terminal plate and the vertical part of this spring is riveted to the lower end portion of the armature thereby positioning the armature so that it may be attracted to the elongated pole pieces of the magnet formed by the legs of the U-shaped configuration.

Terminal plate 15 is secured in the circuit breaker case so that the thermal and magnetic trip subassembly is within the compartment and the left-hand terminal portion extends to the outside, there being an insulator plate 84 closing the opening in the left-hand end of the base above terminal plate 15.

As shown in FIGS. 2–4, magnet 76 is elongated and has a generally U-shape in horizontal cross-section so that it surrounds bimetal strip 14 on the front, right-hand and rear sides throughout a substantial portion of its length. Thus, the left-hand vertical edges of this U-shaped magnet provide a pair of spaced pole pieces in a common plane to which armature 80 may be magnetically attracted.

Armature 80 is a generally flat, rectangular ferrous metal plate having an upstanding narrower portion including a tapped hole near its upper end through which an adjustable screw 80*a* is threaded. As shown in FIG. 2, this screw extends horizontally toward common trip bar 70 and may be adjusted to a suitable gap between this screw and the common trip bar. This armature is provided with means supporting one contact of a shunting switch. This means comprises a rearwardly extending tab shown in dotted lines in FIG. 3 to the right surface to which a contact 80*b* is welded. This contact closes with a complementary contact mounted on a bracket carried by the bimetal strip as hereinafter described. A short, flexible electrical conductor 80*c* connects a second tab 80*d* of the armature to terminal plate 15, as shown in FIG. 3.

Bimetal strip 14 is an upstanding ribbon-like member having a notch at its upper forward corner as shown in FIG. 3 providing clearance for adjustable screw 80*a*. This bimetal strip is provided with means supporting the other contact of the aforesaid shunting switch. This means comprises an electrically conducting bracket 12 attached to the upper end portion of the bimetal strip and depending parallel thereto in substantially the same plane as shown in FIG. 3. A contact 12*a* is welded to the left surface of this bracket as shown in FIG. 4 for engaging contact 80*b* when the armature closes. Bracket 12 is provided at its upper end with a sheared and rightwardly bent tab 12*b* for engaging the common trip bar when the bimetal strip bends or flexes to the right.

An electrically insulating block 84 is slipped onto a notch on the right-rear corner of terminal plate 15. This block is provided with a superimposed notch 84*a* shown in FIG. 4 through which conductor 10 extends to insulate it from the terminal plate.

The field test mechanism is shown in FIG. 8. This mechanism comprises means for tripping the circuit breaker in a manner simulating tripping thereof by overload current. While the breaker contacts can be opened and reclosed by manipulation of operating handle 38, that does not activate the tripping mechanism. Therefore, the field test mechanism is provided for this purpose.

This field test mechanism comprises a rotary member 86 mounted in a hole in the circuit breaker cover and having a screwdriver slot 86*a* in its enlarged head which is accessible from the outside for turning counterclockwise as indicated by the arrow. A radial arm 88 having a downwardly bent end is attached to the internal end of member 86 and is non-rotatably keyed to the internal end of member 86 and is non-rotatably keyed thereto so that it extends laterally parallel to turning slot 86*a*. A helical return spring 90 surrounds the shank of member 86 and is tensioned to swing arm 88 normally clockwise away from common trip bar 70. For this purpose, spring 90 is provided with a hook 90*a* at one end which engages the right side of arm 80 to bias it to the left. The other end of spring 90 has a linear section 90*b* that is held against the adjacent wall of the circuit breaker cover, this wall being formed by the cavity in the internal surface of the cover that provides clearance for arm 88 to swing a limited amount. Thus, when this field trip member is released, the spring will swing arm 88 away from the common trip lever. When it is desired to test the tripping mechanism, a screwdriver is inserted in slot 86*a* and turned counterclockwise until the downward angular part of arm 88 moves common trip bar 70 to the right far enough to release the aforementioned latch.

From the foregoing, it will be apparent that the thermal and magnetic trip subassembly may be assembled on terminal plate 14 beforehand and then attached in the case by screw 17.

For thermal trip, a small overload current gradually heats bimetal strip 14 so that it bends to the right. Tab 12*b* engages common trip lever 70 and releases the latch to trip the breaker contacts. For this purpose, when latch lever 22 is released, spring 42 causes the latch lever to rotate clockwise on its pivot pin 24 until pivot pin 30 crosses to the right of the line of action of the spring. As a result, links 28 and 32 collapse at pivot pin 34 to open the breaker contacts. This is done by links 32 rotating the movable contact finger counterclockwise and rotating shaft 56. Since common shaft 56 also carries the contact finger assemblies in the other pole or poles, they are tripped open by the same action.

To reset the breaker, handle 38 is first swung counterclockwise to engage the latch lever and is then swung clockwise to close the breaker contacts. When the handle is first swung to the left, operating lever 40 engages the latch lever to swing it counterclockwise until its left end hooks into latch 18. When the operating handle is then swung to the right beyond pivot pin 30, spring 42 pulls knee pin 34 to the right to straighten the links 28 and 32 from the collapsed condition. As a result, links 32 force a clockwise rotation of the movable contact finger and common shaft, thereby closing the contacts in all poles.

For magnetic trip, a sudden large overload current flowing in bimetal strip 14 energizes magnet 76 to attract armature 80 toward the right as seen in FIGS. 1, 2 and 4. This causes screw 80*a* to engage the common trip bar to trip the breaker. At the same time contact 80*b* closes with contact 12*a* to shunt the current from the bimetal strip thereby to protect the bimetal strip from sustained large current flow. Normally, the current flows from conductor 10 through bracket 12 and bimetal strip 14 to terminal plate 15. When the shunting contacts close on magnetic trip, the current flows from conductor 10 through bracket 12, contacts 12*a* and 80*b*, armature 80 and its conductor 80*c* to terminal plate 15. As wil be apparent, this path shunts bimetal strip 14 entirely.

The shunting switch is provided with means for rocking the contacts to break any welds that might occur between the shunting contacts. This means comprises mounting one of these contacts on the bimetal strip and the other one on the armature. It will be apparent that on magnetic trip, the large current will not only actuate the armature to trip the breaker but will also cause some deflection of the bimetal strip to the right. Now, as the bimetal strip cools, it will straighten back to the left. If the contacts were welded, this action of the bimetal exerts a significant rocking force on contact 12*a* with respect to contact 80*b* and will tend to crack and peel and separate any weld therebetween so that the shunting switch opens properly, as shown in FIG. 5.

From the foregoing, it will be apparent that the invention has certain advantages in addition to the above over prior known circuit breakers. For example, the thermal and magnetic trip subassembly arrangement affords better electrical connection of these parts by mounting them onto the terminal plate, and it saves parts including one "pigtail" conductor thereby saving also the material such as copper that would otherwise go thereinto.

The field test apparatus has the utmost simplicity and effectiveness since it is flush with the upper surface of the cover and yet is readily accessible for test tripping the breaker with a common and readily available tool such as a screwdriver.

While the apparatus hereinbefore described is effectively adapted to fulfill the objects stated, it is to be understood that the invention is not intended to be confined to the particular preferred form of plural-pole circuit breaker with improved trip mechanism disclosed, inasmuch as it is susceptible of various modifications without departing from the scope of the appended claims.

I claim:

1. In an electrical circuit breaker, the combination comprising:

an insulating housing having a compartment therein enclosing a circuit breaker mechanism comprising:

a pair of terminals extending from said compartment to the exterior for connecting said circuit breaker to an external circuit;

a stationary contact connected to one of said terminals within said compartment;

a movable member having a contact thereon within said compartment operable for engaging or disengaging said stationary contact;

means comprising an operating handle and toggle linkage and latching mechanism for operating said movable member;

tripping means for controlling said latching mechanism to release said toggle linkage and trip said movable member and its contact open;

and a thermal and magnetic trip subassembly for actuating said tripping means in response to overload conditions, said subassembly comprising magnet and bimetal members rigidly mounted on the other terminal with said bimetal member electrically connected thereto, an armature member resiliently mounted on and electrically connected to said other terminal for attraction by said magnet, and means electrically connecting said bimetal member to said movable member so as to form a current path from said one terminal to said other terminal through said stationary and movable contacts.

2. The electrical circuit breaker defined in claim 1, wherein:

said thermal and magnetic trip subassembly comprises shunting switch contacts mounted on said armature and said bimetal members for closing on magnetic trip to shunt said bimetal member and for rocking relative to one another as said bimetal member flexes to break any welds therebetween.

3. The electrical circuit breaker defined in claim 1, wherein:

said movable member is an elongated member having said contact at one end and pivotally mounted for swinging into and out of engagement with said stationary contact;

and an insulating member lining said elongated member from a point adjacent its contact to prevent the arc from restriking said movable member after the contacts open.

4. The electrical circuit breaker defined in claim 1, wherein:

said tripping means comprises field test means including a rotary member mounted on said housing so as to be accessible from the outside and having a radial lever and means within said compartment for releasing said latching means when said rotary member is rotated.

5. The electrical circuit breaker defined in claim 4, wherein:

said tripping means also comprises an helical torsion spring around said rotary member and coupled thereto and to said housing for restoring said rotary member from its rotated position.

6. The electrical circuit breaker defined in claim 1,wherein:

said magnet and bimetal members comprise elongated members having L-shaped supporting ends, which ends are stacked one over the other, and a hole therethrough, and securing means extending through said hole securing said members to said other terminal.

7. The electrical circuit breaker defined in claim 6, wherein:

said magnet member has a generally elongated U-shaped configuration whereby it closely surrounds said bimetal member on three sides throughout a substantial portion of the latter.

8. The electrical circuit breaker defined in claim 7, wherein:

said armature member is a generally flat plate secured by an L-shaped leaf spring to said other terminal in pivotal spaced relation to the elongated edges of the arms of said elongated U-shaped magnet member.

9. The electrical circuit breaker defined in claim 8, wherein:

said electrical connection of said armature comprises a flexible stranded conductor connected between said armature and said other terminal to allow easy swinging of said armature on its said supporting leaf spring when overload current flows in said bimetal member to energize said magnet member.

10. The electrical circuit breaker defined in claim 9, wherein:

said armature member comprises a lateral tab carrying a first contact;

and said bimetal member comprises a bracket carrying a second contact for engagement by said first contact under magnetic trip action, said first and second contacts forming a shunting switch for by-passing current from said bimetal member and being rockable during flexing of said bimetal member to break any welds therebetween.

11. In a plural-pole electrical circuit breaker having an insulating housing including a compartment therein for the circuit breaker mechanism, which mechanism comprises in each pole thereof a pair of terminal plates, one of said plates extending from each end of each said compartment for connection to an external circuit, a stationary contact mounted to one plate of each said pair thereof, and a movable contact finger subassembly having a rotatable shaft extending between compartments and a contact finger having a contact at one end thereof rigidly mounted on said shaft at its other end in each said compartment for limited rotation therewith to close and open said contacts, a manual lever operated overcenter toggle spring and linkage mechanism in one pole thereof including a latch therefor and a common trip mechanism for controlling said latch for setting said movable contact finger in closed position from which it may be tripped open by overload current, the improvement comprising:

a thermal and magnetic trip subassembly in each said compartment for actuating said common trip mechanism comprising:

elongated magnet and bimetal members mounted on and electrically connected to said other terminal plate in parallel so that said bimetal member extends between the poles of said magnet member which has a U-shaped configuration to magnetize the same when current flows in said bimetal member;

an elongated armature member and flexible means mounting the same on and electrically connecting the same to said other terminal plate;

shunt contacts and means mounting the same in electrical connection on said armature and bimetal members respectively for shunting large currents from said bimetal member on magnetic trip;

means for mounting said second terminal plate to said housing whereby to mount said thermal and magnetic trip subassembly in said compartment;

and a flexible conductor connecting said movable contact finger to the shunt contact mounting means of said bimetal member in the respective compartment thereby to allow current flowing through the breaker contacts to flow through said bimetal member when said shunt contacts are open or in shunt thereof through said shunt contacts and said armature member to said other terminal plate when said shunt contacts are closed.

12. The improvement defined in claim 11, wherein said means mounting said shunt contacts in electrical connection on said armature and bimetal members respectively comprise:

a lateral tab on said elongated armature to which one of said shunt contacts is secured;

and an electrically conductive bracket secured to the unconnected end of said elongated bimetal member and having said other shunt contact secured thereto at a point opposite said first shunt contact.

13. The improvement defined in claim 11, wherein:

said second terminal plate has a notch at one corner thereof;

and an insulator in interfitting engagement in said notch and having a superimposed notch for retaining said flexible conductor and insulating the same from said second terminal plate.

14. The improvement defined in claim 11, together with:

a field test tripping device mounted through the wall of one of said compartments and comprising:

a rotary member retained in said wall and having an external means to afford turning thereof;

a radial arm secured to said rotary member within said compartment for actuating said common trip mechanism;

a return spring biasing said rotary member into its unoperated position;

and said common trip mechanism being in the path of movement of said radial arm and extending between breaker poles to effect tripping of all poles when one pole is tripped.

15. The improvements defined in claim 11, together with:

an insulator lining said movable contact finger to prevent the arc from restriking beside the contact thereof when the breaker is tripped open under overload current.

* * * * *